US006988548B2

(12) United States Patent
Diamond et al.

(10) Patent No.: US 6,988,548 B2
(45) Date of Patent: Jan. 24, 2006

(54) METHOD AND SYSTEM FOR REMOVING FLUID FROM A SUBTERRANEAN ZONE USING AN ENLARGED CAVITY

(75) Inventors: Lawrence W. Diamond, Rockwall, TX (US); Joseph A. Zupanick, Pineville, WV (US)

(73) Assignee: CDX Gas, LLC, Dallas, TX (US)

( * ) Notice: Subject to any disclaimer, the term of this patent is extended or adjusted under 35 U.S.C. 154(b) by 0 days.

(21) Appl. No.: 10/264,535

(22) Filed: Oct. 3, 2002

(65) Prior Publication Data

US 2005/0167119 A1 Aug. 4, 2005

(51) Int. Cl.
*E21B 43/00* (2006.01)

(52) U.S. Cl. ..... 166/68; 166/369; 166/68.5; 166/105; 166/50

(58) Field of Classification Search ..... 166/369, 166/370, 68, 68.5, 105, 105.1, 50; 405/53, 405/55

See application file for complete search history.

(56) References Cited

U.S. PATENT DOCUMENTS

| | | | |
|---|---|---|---|
| 54,144 | A | 4/1866 | Hamar |
| 274,740 | A | 3/1883 | Douglass |
| 526,708 | A | 10/1894 | Horton |

(Continued)

FOREIGN PATENT DOCUMENTS

| | | |
|---|---|---|
| CA | 2 278 735 | 1/1998 |
| EP | 0 875 661 A1 | 11/1998 |
| EP | 0 952 300 A1 | 10/1999 |

(Continued)

OTHER PUBLICATIONS

Notification of Transmittal of the International Search Report or the Declaration (PCT Rule 44.1) mailed Feb. 27, 2004 (9 pages) re International Application No. PCT/US 03/30126, Sep. 23, 2003.

Fletcher, "Anadarko Cuts Gas Route Under Canadian River Gorge," Oil and Gas Journal, pp. 28–30, Jan. 25, 2004.

Translation of selected pages of Kalinin, et al., "Drilling Inclined and Horizontal Well Bores," Nedra Publishers, Moscow, 1997, 15 pages.

Translation of selected pages of Arens, V.Zh., "Well–Drilling Recovery of Minerals," Geotechnology, Nedra Publishers, Moscow, 7 pages, 1986.

Robert W. Taylor and Richard Russell, Multilateral Technologies Increase Operational Efficiencies in Middle East, Oil & Gas Journal, pp. 76–80, Mar. 16, 1998.

Adam Pasiczynk, "Evolution Simplifies Multilateral Wells", Directional Drilling, pp. 53–55, Jun. 2000.

Steven S. Bell, "Multilateral System with Full Re–Entry Access Installed", World Oil, p. 29, Jun. 1996.

P. Jackson and S. Kershaw, Reducing Long Term Methane Emissions Resulting from Coal Mining, Energy Convers. Mgmt, vol. 37, Nos 6–8, pp. 801–806, 1996.

Pascal Breant, "Des Puits Branches, Chez Total : les puits multi drains", Total Exploration Production, pp. 1–5, Jan. 1999.

(Continued)

*Primary Examiner*—David Bagnell
*Assistant Examiner*—G M Collins
(74) *Attorney, Agent, or Firm*—Fish & Richardson P.C.

(57) ABSTRACT

A method for removing fluid from a subterranean zone includes drilling a well bore from a surface to the subterranean zone and forming an enlarged cavity in the well bore such that the enlarged cavity acts as a chamber to separate liquid from gas flowing from the subterranean zone through the well bore. The method includes positioning a pump inlet within the enlarged cavity and operating a pumping unit to produce the liquid through the pump inlet. The well bore may comprise an articulated well bore.

34 Claims, 5 Drawing Sheets

U.S. PATENT DOCUMENTS

| | | | |
|---|---|---|---|
| 639,036 | A | 12/1899 | Heald |
| 1,189,560 | A | 7/1916 | Gondos |
| 1,285,347 | A | 11/1918 | Otto |
| 1,467,480 | A | 9/1923 | Hogue |
| 1,485,615 | A | 3/1924 | Jones |
| 1,488,106 | A | 3/1924 | Fitzpatrick |
| 1,674,392 | A | 6/1928 | Flansburg |
| 1,777,961 | A | 10/1930 | Capeliuschnicoff |
| 2,018,285 | A | 10/1935 | Schweitzer et al. |
| 2,069,482 | A | 2/1937 | Seay |
| 2,150,228 | A | 3/1939 | Lamb |
| 2,169,718 | A | 8/1939 | Boll et al. |
| 2,335,085 | A | 11/1943 | Roberts |
| 2,450,223 | A | 9/1948 | Barbour |
| 2,490,350 | A | 12/1949 | Grable |
| 2,726,847 | A | 3/1952 | McCune et al. |
| 2,679,903 | A | 6/1954 | McGowen, Jr. et al. |
| 2,726,063 | A | 12/1955 | Ragland et al. |
| 2,783,018 | A | 2/1957 | Lytle |
| 2,847,189 | A | 8/1958 | Shook |
| 2,911,008 | A | 11/1959 | Du Bois |
| 2,934,904 | A | 5/1960 | Hendrix |
| 2,980,142 | A | 4/1961 | Turak |
| 3,163,211 | A | 12/1964 | Henley |
| 3,208,537 | A | 9/1965 | Scarborough |
| 3,347,595 | A | 10/1967 | Dahms et al. |
| 3,443,648 | A | 5/1969 | Howard |
| 3,473,571 | A | 10/1969 | Dugay |
| 3,503,377 | A | 3/1970 | Beatenbough et al. |
| 3,528,516 | A | 9/1970 | Brown |
| 3,530,675 | A | 9/1970 | Turzillo |
| 3,578,077 | A | 5/1971 | Glenn, Jr. et al. |
| 3,684,041 | A | 8/1972 | Kammerer, Jr. et al. |
| 3,692,041 | A | 9/1972 | Bondi |
| 3,757,876 | A | 9/1973 | Pereau |
| 3,757,877 | A | 9/1973 | Leathers |
| 3,800,830 | A | 4/1974 | Etter |
| 3,809,519 | A | 5/1974 | Garner |
| 3,825,081 | A | 7/1974 | McMahon |
| 3,828,867 | A | 8/1974 | Elwood |
| 3,874,413 | A | 4/1975 | Valdez |
| 3,887,008 | A | 6/1975 | Canfield |
| 3,902,322 | A | 9/1975 | Watanabe |
| 3,907,045 | A | 9/1975 | Dahl et al. |
| 3,934,649 | A | 1/1976 | Pasini, III et al. |
| 3,957,082 | A | 5/1976 | Fuson et al. |
| 3,961,824 | A | 6/1976 | Van Eek et al. |
| 4,011,890 | A | 3/1977 | Andersson |
| 4,022,279 | A | 5/1977 | Driver |
| 4,037,658 | A | 7/1977 | Anderson |
| 4,073,351 | A | 2/1978 | Baum |
| 4,089,374 | A | 5/1978 | Terry |
| 4,116,012 | A | 9/1978 | Abe et al. |
| 4,134,463 | A | 1/1979 | Allen |
| 4,156,437 | A | 5/1979 | Chivens et al. |
| 4,169,510 | A | 10/1979 | Meigs |
| 4,189,184 | A | 2/1980 | Green |
| 4,220,203 | A | 9/1980 | Steeman |
| 4,221,433 | A | 9/1980 | Jacoby |
| 4,224,989 | A | 9/1980 | Blount |
| 4,257,650 | A | 3/1981 | Allen |
| 4,278,137 | A | 7/1981 | Van Eek |
| 4,283,088 | A | 8/1981 | Tabakov et al. |
| 4,296,785 | A | 10/1981 | Vitello et al. |
| 4,299,295 | A | 11/1981 | Gossard |
| 4,305,464 | A | 12/1981 | Masszi |
| 4,312,377 | A | 1/1982 | Knecht |
| 4,317,492 | A | 3/1982 | Summers et al. |
| 4,328,577 | A | 5/1982 | Abbott et al. |
| 4,333,539 | A | 6/1982 | Lyons et al. |
| 4,366,988 | A | 1/1983 | Bodine |
| 4,372,398 | A | 2/1983 | Kuckes |
| 4,386,665 | A | 6/1983 | Dellinger |
| 4,390,067 | A | 6/1983 | Willman |
| 4,396,076 | A | 8/1983 | Inoue |
| 4,397,360 | A | 8/1983 | Schmidt |
| 4,401,171 | A | 8/1983 | Fuchs |
| 4,407,376 | A | 10/1983 | Inoue |
| 4,437,706 | A | 3/1984 | Johnson |
| 4,442,896 | A | 4/1984 | Reale et al. |
| 4,494,616 | A | 1/1985 | McKee |
| 4,512,422 | A | 4/1985 | Knisley |
| 4,519,463 | A | 5/1985 | Schuh |
| 4,527,639 | A | 7/1985 | Dickinson, III et al. |
| 4,532,986 | A | 8/1985 | Mims et al. |
| 4,544,037 | A | 10/1985 | Terry |
| 4,558,744 | A | 12/1985 | Gibb |
| 4,565,252 | A | 1/1986 | Campbell et al. |
| 4,573,541 | A | 3/1986 | Josse et al. |
| 4,599,172 | A | 7/1986 | Gardes |
| 4,600,061 | A | 7/1986 | Richards |
| 4,605,076 | A | 8/1986 | Goodhart |
| 4,611,855 | A | 9/1986 | Richards |
| 4,618,009 | A | 10/1986 | Carter et al. |
| 4,638,949 | A | 1/1987 | Mancel |
| 4,646,836 | A | 3/1987 | Goodhart |
| 4,674,579 | A | 6/1987 | Geller et al. |
| 4,676,313 | A | 6/1987 | Rinaldi |
| 4,702,314 | A | 10/1987 | Geller et al. |
| 4,705,109 | A | 11/1987 | Ledent et al. |
| 4,705,431 | A | 11/1987 | Gadelle et al. |
| 4,715,440 | A | 12/1987 | Boxell et al. |
| 4,718,485 | A | 1/1988 | Brown et al. |
| 4,727,937 | A | 3/1988 | Shum et al. |
| 4,754,819 | A | 7/1988 | Dellinger |
| 4,756,367 | A | 7/1988 | Puri et al. |
| 4,763,734 | A | 8/1988 | Dickinson et al. |
| 4,773,488 | A | 9/1988 | Bell et al. |
| 4,830,105 | A | 5/1989 | Petermann |
| 4,836,611 | A | 6/1989 | El-Saie |
| 4,842,081 | A | 6/1989 | Parant |
| 4,844,182 | A | 7/1989 | Tolle |
| 4,852,666 | A | 8/1989 | Brunet et al. |
| 4,883,122 | A | 11/1989 | Puri et al. |
| 4,978,172 | A | 12/1990 | Schwoebel et al. |
| 5,016,709 | A | 5/1991 | Combe et al. |
| 5,016,710 | A | 5/1991 | Renard et al. |
| 5,033,550 | A | 7/1991 | Johnson et al. |
| 5,035,605 | A | 7/1991 | Dinerman et al. |
| 5,036,921 | A | 8/1991 | Pittard et al. |
| 5,074,360 | A | 12/1991 | Guinn |
| 5,074,365 | A | 12/1991 | Kuckes |
| 5,074,366 | A | 12/1991 | Karlsson et al. |
| 5,082,054 | A | 1/1992 | Kiamanesh |
| 5,111,893 | A | 5/1992 | Kvello-Aune |
| 5,115,872 | A | 5/1992 | Brunet et al. |
| 5,135,058 | A | 8/1992 | Millgard et al. |
| 5,148,875 | A | 9/1992 | Karlsson et al. |
| 5,165,491 | A | 11/1992 | Wilson |
| 5,168,942 | A | 12/1992 | Wydrinski |
| 5,174,374 | A | 12/1992 | Hailey |
| 5,193,620 | A | 3/1993 | Braddick |
| 5,194,859 | A | 3/1993 | Warren |
| 5,197,553 | A | 3/1993 | Leturno |
| 5,197,783 | A | 3/1993 | Theimer et al. |
| 5,199,496 | A | 4/1993 | Redus et al. |
| 5,201,817 | A | 4/1993 | Hailey |
| 5,217,076 | A | 6/1993 | Masek |
| 5,226,495 | A | 7/1993 | Jennings, Jr. |
| 5,240,350 | A | 8/1993 | Yamaguchi et al. |
| 5,242,017 | A | 9/1993 | Hailey |

| | | | |
|---|---|---|---|
| 5,242,025 | A | 9/1993 | Neill et al. |
| 5,246,273 | A | 9/1993 | Rosar |
| 5,255,741 | A | 10/1993 | Alexander |
| 5,271,472 | A | 12/1993 | Leturno |
| 5,289,888 | A | 3/1994 | Talley |
| 5,301,760 | A | 4/1994 | Graham |
| 5,343,965 | A | 9/1994 | Talley et al. |
| 5,363,927 | A | 11/1994 | Frank |
| 5,385,205 | A | 1/1995 | Hailey |
| 5,394,950 | A | 3/1995 | Gardes |
| 5,402,851 | A | 4/1995 | Baiton |
| 5,411,082 | A | 5/1995 | Kennedy |
| 5,411,085 | A | 5/1995 | Moore et al. |
| 5,411,088 | A | 5/1995 | LeBlanc et al. |
| 5,411,104 | A | 5/1995 | Stanley |
| 5,411,105 | A | 5/1995 | Gray |
| 5,431,220 | A | 7/1995 | Lennon et al. |
| 5,435,400 | A | 7/1995 | Smith |
| 5,447,416 | A | 9/1995 | Wittrisch |
| 5,450,902 | A | 9/1995 | Matthews |
| 5,454,419 | A | 10/1995 | Vloedman |
| 5,458,209 | A | 10/1995 | Hayes et al. |
| 5,462,116 | A | 10/1995 | Carroll |
| 5,462,120 | A | 10/1995 | Gondouin |
| 5,469,155 | A | 11/1995 | Archambeault et al. |
| 5,477,923 | A | 12/1995 | Jordan, Jr. et al. |
| 5,485,089 | A | 1/1996 | Kuckes |
| 5,494,121 | A | 2/1996 | Nackerud |
| 5,499,687 | A | 3/1996 | Lee |
| 5,501,273 | A | 3/1996 | Puri |
| 5,501,279 | A | 3/1996 | Garg et al. |
| 5,584,605 | A | 12/1996 | Beard et al. |
| 5,615,739 | A | 4/1997 | Dallas |
| 5,653,286 | A | 8/1997 | McCoy et al. |
| 5,669,444 | A | 9/1997 | Riese et al. |
| 5,680,901 | A | 10/1997 | Gardes |
| 5,690,390 | A | 11/1997 | Bithell |
| 5,706,871 | A | 1/1998 | Anderson et al. |
| 5,720,356 | A | 2/1998 | Gardes |
| 5,727,629 | A | 3/1998 | Blizzard, Jr. et al. |
| 5,735,350 | A | 4/1998 | Longbottom et al. |
| 5,771,976 | A | 6/1998 | Talley |
| 5,775,433 | A | 7/1998 | Hammett et al. |
| 5,785,133 | A | 7/1998 | Murray et al. |
| 5,832,958 | A | 11/1998 | Cheng |
| 5,853,054 | A | 12/1998 | McGarian et al. |
| 5,853,056 | A | 12/1998 | Landers |
| 5,863,283 | A | 1/1999 | Gardes |
| 5,868,202 | A | 2/1999 | Hsu |
| 5,868,210 | A | 2/1999 | Johnson et al. |
| 5,879,057 | A | 3/1999 | Schwoebel et al. |
| 5,884,704 | A | 3/1999 | Longbottom et al. |
| 5,917,325 | A | 6/1999 | Smith |
| 5,934,390 | A | 8/1999 | Uthe |
| 5,938,004 | A | 8/1999 | Roberts et al. |
| 5,941,307 | A | 8/1999 | Tubel |
| 5,944,107 | A | 8/1999 | Ohmer |
| 5,957,539 | A | 9/1999 | Durup et al. |
| 5,971,074 | A | 10/1999 | Longbottom et al. |
| 5,988,278 | A | 11/1999 | Johnson |
| 5,992,524 | A | 11/1999 | Graham |
| 6,012,520 | A | 1/2000 | Yu et al. |
| 6,015,012 | A | 1/2000 | Reddick |
| 6,024,171 | A | 2/2000 | Montgomery et al. |
| 6,050,335 | A | 4/2000 | Parsons |
| 6,056,059 | A | 5/2000 | Ohmer |
| 6,065,550 | A | 5/2000 | Gardes |
| 6,079,495 | A | 6/2000 | Ohmer |
| 6,089,322 | A | 7/2000 | Kelley et al. |
| 6,119,771 | A | 9/2000 | Gano et al. |
| 6,135,208 | A | 10/2000 | Gano et al. |
| 6,170,571 | B1 | 1/2001 | Ohmer |
| 6,179,054 | B1 | 1/2001 | Stewart |
| 6,192,988 | B1 | 2/2001 | Tubel |
| 6,199,633 | B1 | 3/2001 | Longbottom |
| 6,209,636 | B1 | 4/2001 | Roberts et al. |
| 6,247,532 | B1 | 6/2001 | Ohmer |
| 6,263,965 | B1 | 7/2001 | Schmidt et al. |
| 6,280,000 | B1 | 8/2001 | Zupanick |
| 6,283,216 | B1 | 9/2001 | Ohmer |
| 6,318,457 | B1 | 11/2001 | Den Boer et al. |
| 6,349,769 | B1 | 2/2002 | Ohmer |
| 6,357,523 | B1 | 3/2002 | Zupanick |
| 6,357,530 | B1 | 3/2002 | Kennedy et al. |
| 6,425,448 | B1 | 7/2002 | Zupanick et al. |
| 6,470,978 | B2 | 10/2002 | Trueman et al. |
| 6,491,101 | B2 | 12/2002 | Ohmer |
| 6,554,063 | B2 | 4/2003 | Ohmer |
| 6,557,628 | B2 | 5/2003 | Ohmer |
| 6,564,867 | B2 | 5/2003 | Ohmer |
| 6,566,649 | B1 | 5/2003 | Mickael |
| 6,571,888 | B2 | 6/2003 | Comeau et al. |
| 6,577,129 | B1 | 6/2003 | Thompson et al. |
| 6,585,061 | B2 | 7/2003 | Radzinski et al. |
| 6,590,202 | B2 | 7/2003 | Mickael |
| 6,591,903 | B2 | 7/2003 | Ingle et al. |
| 6,607,042 | B2 | 8/2003 | Hoyer et al. |
| 6,636,159 | B1 | 10/2003 | Winnacker |
| 6,639,210 | B2 | 10/2003 | Odom et al. |
| 6,646,441 | B2 | 11/2003 | Thompson et al. |
| 6,653,839 | B2 | 11/2003 | Yuratich et al. |
| 2002/0050358 | A1 | 5/2002 | Algeroy et al. |
| 2002/0074120 | A1 | 6/2002 | Scott |
| 2003/0066686 | A1 | 4/2003 | Conn |
| 2004/0020655 | A1 | 2/2004 | Rusby et al. |

FOREIGN PATENT DOCUMENTS

| | | | |
|---|---|---|---|
| FR | 964503 | 4/1944 | ..... 8/1 |
| GB | 750108 | 6/1975 | |
| GB | 1448078 A1 | 3/1987 | |
| GB | 1770570 A1 | 3/1990 | |
| GB | 2 255 033 | 10/1992 | |
| GB | 2 297 988 | 8/1996 | |
| GB | 2 347 157 A | 8/2000 | |
| RU | 750108 | 6/1975 | |
| RU | 1448078 A1 | 3/1987 | |
| RU | 1770570 A1 | 3/1990 | |
| WO | 94/21889 | 9/1994 | |
| WO | WO 97/21900 | 6/1997 | |
| WO | WO 98/25005 | 6/1998 | |
| WO | WO 98/35133 | 8/1998 | |
| WO | WO 99/60248 | 11/1999 | |
| WO | 00/31376 | 6/2000 | |
| WO | WO 00/79099 | 12/2000 | |
| WO | WO 01/44620 | 6/2001 | |
| WO | WO 02/18738 | 3/2002 | |
| WO | WO 02/059455 | 8/2002 | |
| WO | WO 02/061238 | 8/2002 | |
| WO | WO 03/102348 | 12/2003 | |
| WO | WO 2005/003509 | 1/2005 | |

OTHER PUBLICATIONS

Notification of Transmittal of the International Search Report or the Declaration (PCT Rule 44.1) mailed Nov. 6, 2003 (8 pages) re International Application No. PCT/US 03/21626, Filed on Jul. 11, 2003.

Notification of Transmittal of the International Search Report or the Declaration (PCT Rule 44.1) mailed Nov. 5, 2003 (8 pages) re International Application No. PCT/US 03/21627, Filed Jul. 11, 2003.

Notification of Transmittal of the International Search Report or the Declaration (PCT Rule 44.1) mailed Nov. 4, 2003 (7 pages) re International Application No. PCT/US 03/21628, Filed Jul. 11, 2003.

Notification of Transmittal of the International Search Report or the Declaration (PCT Rule 44.1) mailed Dec. 5, 2003 (8 pages) re International Application No. PCT/US 03/21750, Filed Jul. 11, 2003.

Examiner of Record, Office Action Response regarding the Interpretation of the three Russian Patent Applications listed above under Foreign Patent Document (9 pages), Date Unknown.

B. Gotas et al., "*Performance of Openhole Completed and Cased Horizontal/Undulating Wells in Thin–Bedded, Tight Sand Gas Reservoirs*," Society of Petroleum Engineers, Inc., Oct. 17 through Oct. 19, 2000, pp. 1–7, Oct. 19, 2000.

R. Sharma, et al., "*Modelling of Undulating Wellbore Trajectories, The Journal of Canadian Petroleum Technology*", XP–002261908, Oct. 18–20, 1993, pp 16–24, Oct. 18, 2000–Oct. 20, 2000.

E. F. Balbinski et al., "*Prediction of Offshore Viscous Oil Fluid Performance*," European Symposium on Improved Oil Recovery, Aug. 18–20 1999, pp. 1–10, Aug. 18, 1999–Aug. 20, 2000.

McCray and Cole, "Oil Well Drilling and Technology," *University of Oklahoma Press*, pp 315–319, 1959.

Berger and Anderson, "Modern Petroleum;" *PennWell Books*, pp 106–108, 1978.

Howard L. Hartman, et al.; "SME Mining Engineering Handbook;" *Society for Mining, Metallurgy, and Exploration, Inc.*; pp 1946–1950, 2nd Edition, vol. 2, 1992.

Dave Hassan, Mike Chernichen, Earl Jensen, and Morley Frank; "Multi–lateral technique lowers drilling costs, provides environmental benefits", *Drilling Technology*, pp. 41–47, Oct. 1999.

Gopal Ramaswamy, "Production History Provides CBM Insights," *Oil & Gas Journal*, pp. 49, 50 and 52, Apr. 2, 2001.

Arfon H. Jones et al., A Review of the Physical and Mechanical Properties of Coal with Implications for Coal–Bed Methane Methane Well Completion and Production, *Rocky Mountain Association of Geologists*, pp. 169–181, 1988.

Joseph C. Stevens, Horizontal Applications For Coal Bed Methane Recovery, *Strategic Research Institute*, pp. 1–10 (slides), Mar. 25, 2002.

Weiguo Chi and Luwu Yang, "Feasibility of Coalbed Methane Exploitation in China," *Horizontal Well Technology*, p. 74, Sep. 2001.

Nackerud Product Description, *Harvest Tool Company,LLC*, 1 page, Received Sep. 27, 2001.

Gopal Ramaswamy, "Advances Key For Coalbed Methane," *The American Oil & Gas Reporter*, pp. 71 & 73, Oct. 2001.

R.J. "Bob" Stayton, "Horizontal Wells Boost CBM Recovery", Special Report: Horizontal & Directional Drilling, *The American Oil & Gas Reporter*, pp. 71–75, Aug. 2002.

U.S. patent application Ser. No. 09/769,098, entitled "Method and System for Enhanced Access to a Subterranean Zone," filed Jan. 24, 2001, 65 pages (067083.0118).

U.S. patent application Ser. No. 09/774,996, entitled "Method and System for Accessing a Subterranean Zone From a Limited Surface Area," filed Jan. 30, 2001, 67 pages. (067083.0120).

U.S. patent application Ser. No. 09/788,897, entitled "Method and System for Accessing Subterranean Deposits From The Surface," filed Feb. 20, 2001, 54 pages. (067083.0138).

U.S. patent application Ser. No. 10/142,817, entitled "Method and System for Underground Treatment of Materials," filed May 8, 2002, 54 pgs. (067083.0119).

U.S. patent application Ser. No. 09/885,219, entitled "Method and System for Accessing Subterranean Deposits From The Surface," filed Jun. 20, 2001, 52 pages. (067083.0140).

U.S. patent application Ser. No. 10/046,001, entitled "Method and System for Management of By–Products From Subterranean Zones," filed Oct. 19, 2001. 42 pages. (067083.0134).

U.S. patent application Ser. No. 10/004,316, entitled "Slant Entry Well System and Method," filed Oct. 30, 2001, 35 pages. (067083.0162).

U.S. patent application Ser. No. 10/123,561, entitled "Method and System for Accessing Subterranean Zones Fromr a Limited Surface," filed Apr. 5, 2002, 49 pages. (067083.0193).

U.S. patent application Ser. No. 10/123,556, entitled "Method and System for Accessing Subterranean Zones From a Limited Surface," filed Apr. 5, 2002, 49 pages, 49 pages. (067083.0194).

U.S. patent application Ser. No. 10/165,627, entitled "Method and System for Accessing Subterranean Deposits from the Surface," filed Jun. 7, 2002, 26 pages. (067083.0184).

U.S. patent application Ser. No. 10/165,625, entitled "Method and System for Accessing Subterranean Deposits from the Surface," filed Jun. 7, 2002, 26 pages. (067083.0185).

Pend Pat App, Joseph A. Zupanick, "Method and System for Accessing a Subterranean Zone From a Limited Surface," SN 10/188,141 (067083.0201), Jul. 1, 2002.

Pend Pat App, Joseph A. Zupanick, "Undulating Well Bore," SN 10/194,366 (067083.0176), Jul. 12, 2002.

Pend Pat App, Joseph A. Zupanick, "Ramping Well Bores," SN 10/194,367 (067083.0179), Jul. 12, 2002.

Pend Pat App, Joseph A. Zupanick, "Wellbore Sealing System and Method," SN 10/194,368 (067083.0188), Jul. 12, 2002.

Pend Pat App, Joseph A. Zupanick, "Wellbore Plug System and Method," SN 10/194,422 (067083.0189), Jul. 12, 2002.

Pend Pat App, Joseph A. Zupanick, "System and Method for Subterranean Access" SN 10/227,057 (0181), Aug. 22, 2002.

US. patent application Publication No. US 2002/0074122 A1 Method and Apparatus for Hydrocarbon Subterranean Recover, Inventor: Kelley et al, Jun. 20, 2002.

US. patent application Publication No. US 2002/0096336 A1 "Method and System for Surface Production of Gas From a Subterranean Zone", Inventor: Zupanick et al. (067083.0161), Jul. 25, 2002.

US. patent application Publication No. US 2002/0015574 A1 "Method and System for Accessing Subterranean Deposits From the Surface", Inventor: Zupanick et al. (067083.0137), Jul. 25, 2002.

US. patent application Publication No. US 2002/0010432 A1 "Method and System for Accessing Subterranean Deposits From the Surface", Inventor: Zupanick (067083.0139), Aug. 2, 2001.

Pend Pat App, Joseph A. Zupanick et al., Method and System for Controlling Pressure in a Dual Well System (0187), Sep. 12, 2002.
Pend Pat App, Joseph A. Zupanick, "Three–Dimensional Well System for Accessing Subterranean Zones", SN 10/244,083 (0190), Sep. 12, 2002.
Pend Pat App, Joseph A. Zupanick, "Accelerated Production of Gas From a Subterranean Zone", SN 10/246,052 (0175), Sep. 17, 2002.
Susan Eaton, "Reversal of Fortune", New Technology Magazine, pp 30–31, Sep. 2002.
James Mahony, "A Shadow of Things to Come", New Technology Magazine, pp. 28–29, Sep. 2002.
Documents Received from Third Party, Great Lakes Directional Drilling, Inc., (12 pages), Received Sep. 12, 2002.
Notification of Transmittal of the International Search Report or the Declaration (PCT Rule 44.1) mailed Dec. 19, 2003 (6 pages) re International Application No. PCT/US 03/28137, Dec. 19, 2003.
Notification of Transmittal of the International Search Report or the Declaration (PCT Rule 44.1) mailed Feb. 4, 2004 (8 pages) re International Application No. PCT/US 03/26124, Feb. 4, 2004.
Smith, Maurice, "*Chasing Unconventional Gas Unconventionally*," CBM Gas Technology, New Technology Magazine, Oct./Nov. 2003, pp. 1–4, Oct. 2003–Nov. 2003.
Gardes, Robert "*A New Direction in Coalbed Methane and Shale Gas Recovery*," (to the best of Applicants' recollection, first received at The Canadian Institute Coalbed Methane Symposium conference on Jun. 16 and Jun. 17, 2002), 1 page of conference flyer, 6 pages of document, Jun. 16, 2002–Jun. 17, 2002.
Gardes, Robert "*Under–Balance Multi–Lateral Drilling for Unconventional Gas Recovery*," (to the best of Applicants' recollection, first received at The Unconventional Gas Revolution conference on Dec. 9, 2003), 4 pages of conference flyer, 33 pages of document, Dec. 9, 2003.
Boyce, Richard "*HIgh Resolution Selsmic Imaging Programs for Coalbed Methane Development*," (to the best of Applicants' recollection, first received at The Unconventional Gas Revolution conference of Dec. 10, 2003), 4 pages of conference flyer, 24 pages of document, Dec. 10, 2003.
Mark Mazzella and David Strickland, "*Well Control Operations on a Multiwell Platform Blowout*," WorldOil.com—Online Magazine Article, vol. 22, Part I—pp. 1–7, and Part II—pp. 1–13, Jan. 2002.
Vector Magnetics LLC, Case HIstory, California, May 1999, "Successful Kill of a Surface Blowout," pp. 1–12, May 1999.
Cudd Pressure Control, Inc, "*Successful Well Control Operations—A Case Study: Surface and Subsurface Well Intervention on a Multi–Well Offshore Platform Blowout and Fire*," pp. 1–17, http://www.cuddwellcontrol.com/literature/successful/successful_well.htm, 2000.
R. Purl, et al., "*Damage to Coal Permeability During Hydraulic Fracturing*," pp. 109–115 (SPE 21813), 1991.
U.S. Dept. of Energy—Office of Fossil Energy, "*Multi–Seam Well Completion Technology: Implications for Powder River Basin Coalbed Methane Production*," pp. 1–100, A–1 through A10, Sep. 2003.
U.S. Dept. of Energy—Office of Fossil Energy, "*Powder River Basin Coalbed Methane Development and Produced Water Management Study*," pp. 1–111, A–1 through A14, Sep. 2003.
Dreilung, Tim, McClelland, M.L. and Bilyeu, Brad, "Horizontal & High Angle Air Drilling in the San Juan Basin, New Mexico," Believed to be dated Apr. 1996, pp. 1–11.
Technology Scen Drilling & Intervention Services, "Weatherford Moves Into Advanced Multilateral Well Completion Technology" and "Productivity Gains and Safety Record Speed Acceptance of UBS," *Resevoir Mechanics*, Weatherford International, Inc., 2000 Annual Report (2 pages).
"A Different Direction for CBM Wells," *W Magazine*, 2004 Third Quarter (5 pages).
Snyder, Robert E., "What's New in Production," *WorldOil Magazine*, Feb. 2005, [printed from the internet on Mar. 7, 2005], http://www.worldoil.com/magazine/MAGAZINE DETAIL.asp? ART ID=2507@MONTH YEAR (3 pages).
Nazzal, Greg, "Moving Multilateral Systems to the Next Level, Strategic Acquisition Expands Weatherford's Capabilities," 2000 (2 pages).
Bahr, Angie, "Methane Draining Technology Boosts Safety and Energy Production," Energy Review, Feb. 4, 2005, Website: www.energyreview.net/storyviewprint.asp, printed Feb. 7, 2005 (2 pages).
Molvar, Erik M., "Drilling Smarter: Using Directional Drilling to Reduce Oil and Gas Impacts in the Intermountain West," Prepared by Biodiversity Conservation Alliance, Report issued Feb. 18, 2003, 34 pages.
King, Robert F., "Drilling Sideways—A Review of Horizontal Well Technology and Its Domestic Application," DOE/EIA–TR–0565, U.S. Department of Energy, Apr. 1993, 30 pages.
Santos, Helio, SPE, Impact Engineering Solutions and Jesus Olaya, Ecopetro1/ICP, "*No Damage Drilling: How to Achieve this Challenging Goal?*," SPE 77189, Copyright 2002, presented at the IADC/SPE Asia Pacific Drilling Technology, Jakarta, Indonesia, Sep. 9–11, 2002, 10 pages.
Santos, Helio, SPE, Impact Engineering Solutions, "*Increasing Leakoff Pressure with New Class of Drilling Fluid*," SPE 78243, Copyright 2002, presented at the SPE/ISRM Rock Mechanics Conference in Irving, Texas, Oct. 20–23, 2002, 7 pages.
Franck Labenski, Paul Reid, SPE, and Helio Santos, SPE, Impact Solutions Group, "*Drilling Fluids Approaches for Control of Wellbore Instability in Fractured Formations*," SPE/IADC 85304, Society of Petroleum Engineers, Copyright 2003, presented at the SPE/IADC Middle East Drilling Technology Conference & Exhibition in Abu Chabi, UAE, Oct. 20–22/2003, 8 pages.
P. Reid, SPE, and H. Santos, SPE, Impact Solutions Group, "*Novel Drilling, Completion and Workover Fluids for Depleted Zones: Avoiding Losses, Formation Damage and Stuck Pipe,*" SPE/IADC 85326, Society of Petroleum Engineers, Copyright 2003, presented at the SPE/IADC Middle East Drilling Conference & Exhibition in Abu Chabi, UAE, Oct. 20–22/2003, 9 pages.
Craig C. White and Adrian P. Chesters, NAM; Catalin D. Ivan, Sven Maikranz and Rob Nouris, M–I L.L.C., "*Aphron–based drilling fluid: Novel technology for drilling depleted formations*," WORLD OIL, Drilling Report Special Focus, Oct. 2003, 5 pages.
Robert E. Snyder, "Drilling Advances," WORLD OIL, Oct. 2003, 1 page.

U.S. Environmental Protection Agency, "Directional Drilling Technology," prepared for the EPA by Avdvance Resources International under Contract 68–W–00–094, Coalbed Methane Outreach Program (CMOP), published Dec. 2002, Website: http://search.epa.gov/s97is.vts, printed Mar. 17, 2005, 13 pages.
"Meridian Tests New Technology," Western Oil World, Jun. 1990, Cover, Table of Contents and p. 13.
Clint Leazer and Michael R. Marquez, "Short–Radius Drilling Expands Horizontal Well Applications," Petroleum Engineer International, Apr. 1995, 6 pages.
Terry R. Logan, "Horizontal Drainhole Drilling Techniques Used in Rocky Mountains Coal Seams," Geology and Coal–Bed Methane Resources of the Northern San Juan Basin, Colorado and New Mexico, Rocky Mountain Association of Geologists, Coal–Bed Methane, San Juan Basin, 1988, pp. cover, 133–142.
Daniel J. Brunner, Jeffrey J. Schwoebel, and Scott Thomson, "Directional Drilling for Methane Drainage & Exploration in Advance of Mining," Website: http://www.advminingtech.com.au/Paper4.htm, printed Apr. 6, 2005, Copyright 1999, Last modified Aug. 7, 2002 (8 pages).
Karen Bybee, highlights of paper SPE 84424, "Coalbed–Methane Reservoir Simulation: An Evolving Science," by T.L. Hower, JPT Online, Apr. 2004, Website: http://www.spe.org/spe/jpt/jsp/jptpapersynopsis/0,2439,1104 11038 2354946 2395832,00.html, printed Apr. 14, 2005, 4 pages.
Kevin Meaney and Lincoln Paterson, "Relative Permeability in Coal," SPE 36986, Society of Petroleum Engineers, Copyright 1996, pp. 231–236.
Calendar of Events –Conference Agenda, Fifth Annual Unconventional Gas and Coalbed Methane Conference, Oct. 22–24, 2003, in Calgary Alberta, Website: http://www.csug.ca/cal/calc0301a.html, printed Mar. 17, 2005, 5 pages.
Tom Engler and Kent Perry, "Creating a Roadmap for Unconventional Gas R&D," Gas TIPS, Fall 2002, pp. 16–20.
CSIRO Petroleum –SIMEDWin, "Summary of SIMEDWin Capabilities," Copyright 1997–2005, Website: http://www.dpr.csiro.au/ourcapabilities/petroleumgeoengineering/reservoirengineering/projects/simedwin/assets/simed/index.html, printed Mar. 17, 2005, 10 pages.
Solutions From the Field, "Coalbed Methane Resources in the Southeast," Copyright 2004, Website: http://www.pttc.org/solutions/sol 2004/537.htm, printed Mar. 17, 2005, 7 pages.
Jeffrey R. Levine, Ph.D., "Matrix Shrinkage Coefficient," Undated, 3 pages.
G. Twombly, S.H. Stepanek, T.A. Moore, Coalbed Methane Potential in the Waikato Coalfield of New Zealand: A Comparison With Developed Basins in the United States, 2004 New Zealand Petroleum Conference Proceedings, Mar. 7–10, 2004, pp. 1–6.
R.W. Cade, "Horizontal Wells: Development and Applications," Presented at the Fifth International Symposium on Geophysics for Mineral, Geotechnical and Environmental Applications, Oct. 24–28, 1993 in Tulsa, Oklahoma, Website: http://www.mgls.org/93Sym/Cade/cade.html, printed Mar. 17, 2005, 6 pages.
Solutions From the Field, "Horizontal Drilling, A Technology Update for the Appalachian Basin," Copyright 2004, Website: http://www.pttc.org/solutions/sol 2004/535.htm, printed Mar. 17, 2005, 6 pages.
R. Purl, J.C. Evanoff and M.L. Brugler, "Measurement of Coal Cleat Porosity and Relative Permeability Characteristics," SPE 21491, Society of Petroleum Engineers, Copyright 1991, pp. 93–104.
Peter Jackson, "Drilling Technologies for Underground Coal Gasification," IMC Geophysics Ltd., International UCG Workshop –Oct. 2003 (20 pages).
Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/002162 mailed Apr. 22, 2005.
Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/005289 mailed Apr. 29, 2005.
Notification of Transmittal of the International Search Report and the Written Opinion of the International Searching Authority, or the Declaration (3 pages), International Searching Report (5 pages) and Written Opinion of the International Searching Authority (5 pages) re International Application No. PCT/US2004/036616 mailed Feb. 24, 2005.
Notification of Transmittal of International Preliminary Examination Report (1 page) and International Preliminary Examination Report (3 pages) for International Application No. PCT/US03/13954 mailed Apr. 14, 2005.
Notification of Transmittal of International Preliminary Examination Report (1 page) and International Preliminary Examination Report (5 pages) mailed Jan. 18, 2005 and Written Opinion (8 pages) mailed Aug. 25, 2005 for International Application No. PCT/US03/30126.
Notification of Transmittal of the International Search Report or the Declaration (3 pages) and International Search Report (5 pages) mailed Nov. 10, 2000 for International Application No. PCT/US99/27494.
Notification of Transmittal of International Preliminary Examination Report (1 page) and International Preliminary Examination Report (6 pages) mailed Apr. 2, 2001 and Written Opinion mailed Sep. 27, 2000 for International Application No. PCT/US99/27494.
Notification of Transmittal of the International Search Report or the Declaration (3 pages) and International Search Report (5 pages) mailed Jun. 6, 2002 for International Application No. PCT/US02/02051.
Notification of Transmittal of the International Search Report or the Declaration (3 pages) and International Search Report (6 pages) mailed Mar. 13, 2003 for International Application No. PC/US02/33128.
Notification of Transmittal of International Preliminary Examination Report (1 page) and International Preliminary Examination Report (3 pages mailed Apr. 22, 2004 and Written Opinion mailed Sep. 4, 2003 for International Application No. PCT/US02/33128.

METHOD AND SYSTEM FOR REMOVING FLUID FROM A SUBTERRANEAN ZONE USING AN ENLARGED CAVITY

TECHNICAL FIELD OF THE INVENTION

The present invention relates generally to the recovery of subterranean deposits, and more particularly to a method and system for removing fluid from a subterranean zone using an enlarged cavity.

BACKGROUND OF THE INVENTION

Subterranean zones, such as coal seams, contain substantial quantities of entrained methane gas. Subterranean zones are also often associated with liquid, such as water, which must be drained from the zone in order to produce the methane. When removing such liquid, entrained coal fines and other fluids from the subterranean zone through pumping, methane gas may enter the pump inlet which reduces pump efficiency.

SUMMARY OF THE INVENTION

The present invention provides a method and system for removing fluid from a subterranean zone using an enlarged cavity that substantially eliminates or reduces at least some of the disadvantages and problems associated with previous methods and systems.

In accordance with a particular embodiment of the present invention, a method for removing fluid from a subterranean zone includes drilling a well bore from a surface to the subterranean zone and forming an enlarged cavity in the well bore such that the enlarged cavity acts as a chamber to separate liquid from gas flowing from the subterranean zone through the well bore. The method includes positioning a pump inlet within the enlarged cavity and operating a pumping unit to produce the liquid through the pump inlet.

The well bore may comprise an articulated well bore. Positioning a pump inlet within the enlarged cavity may comprise positioning a pump inlet within the enlarged cavity such that the pump inlet is offset from the flow of gas through the well bore. Forming an enlarged cavity in the well bore may comprise forming an enlarged cavity in a substantially vertical portion of the articulated well bore. The pump inlet may be horizontally offset from a longitudinal axis of the substantially vertical portion of the articulated well bore.

In accordance with another embodiment, a system for removing fluid from a subterranean zone includes a well bore extending from a surface to the subterranean zone and an enlarged cavity formed in the well bore. The enlarged cavity is configured to act as a chamber to separate liquid from gas flowing from the subterranean zone through the well bore. The system includes a pumping unit having a pump inlet positioned within the enlarged cavity. The pumping unit is operable to produce the liquid through the pump inlet.

Technical advantages of particular embodiments of the present invention include forming an enlarged cavity of an articulated well bore that enables liquid to separate from gas in the flow of fluid from a subterranean zone through the well bore at the enlarged cavity. The enlarged cavity also enables a user to position a pump inlet offset from the flow of gas through the articulated well bore. Thus, fluids and entrained coal fines pumped from the subterranean zone through the articulated well bore will contain less gas, resulting in greater pump efficiency.

The enlarged cavity may be formed in a substantially horizontal portion or a substantially vertical portion of the articulated well bore. If the enlarged cavity is formed in a substantially horizontal portion of the articulated well bore, the pump inlet may be positioned within the enlarged cavity such that it is vertically offset from the longitudinal axis of the substantially horizontal portion. If the enlarged cavity is formed in a substantially vertical portion of the articulated well bore, the pump inlet may be positioned within the enlarged cavity such that it is horizontally offset from the longitudinal axis of the substantially vertical portion. Positioning the pump inlet in this manner allows gas of a subterranean zone to bypass the pump inlet when fluids and/or entrained coal fines are pumped through the articulated well bore.

Other technical advantages will be readily apparent to one skilled in the art from the following figures, descriptions and claims. Moreover, while specific advantages have been enumerated above, various embodiments may include all, some or none of the enumerated advantages.

BRIEF DESCRIPTION OF THE DRAWINGS

For a more complete understanding of particular embodiments of the invention and their advantages, reference is now made to the following descriptions, taken in conjunction with the accompanying drawings, in which.

DETAILED DESCRIPTION OF THE INVENTION

Figure 1:
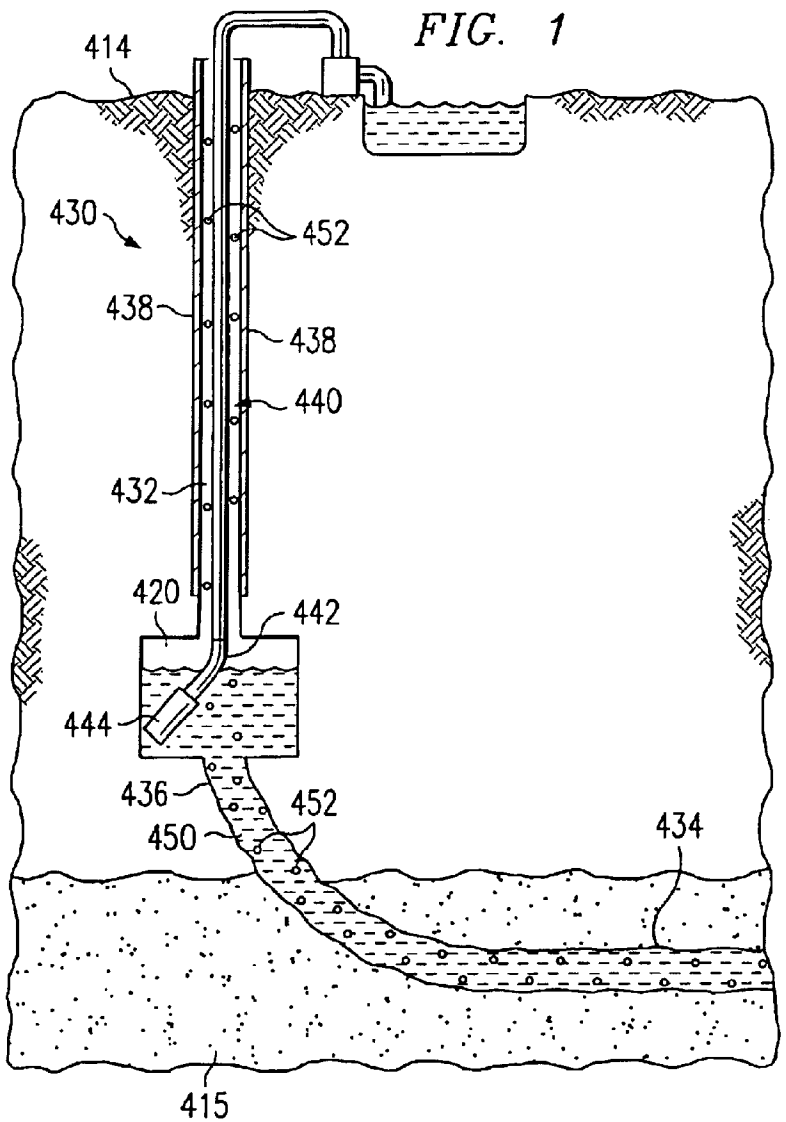
FIG. 1 illustrates an example well system for removing fluid from a subterranean zone utilizing an enlarged cavity in a substantially vertical portion of an articulated well bore, in accordance with an embodiment of the present invention.

FIG. 1 illustrates an example well system for removing fluid from a subterranean zone. An articulated well bore 430 extends from surface 414 to subterranean zone 415. In this embodiment, subterranean zone 415 comprises a coal seam, however subterranean zones in accordance with other embodiments may comprise other compositions, such as shale.

Articulated well bore 430 includes a substantially vertical portion 432, a substantially horizontal portion 434 and a curved or radiused portion 436 interconnecting vertical and horizontal portions 432 and 434. Horizontal portion 434 lies substantially in the horizontal plane of subterranean zone 415. In particular embodiments, articulated well bore 430 may not include a horizontal portion, for example, if subterranean zone 415 is not horizontal. In such cases, articulated well bore 430 may include a portion substantially in the same plane as subterranean zone 415. Articulated well bore 430 may be drilled using an articulated drill string. Articulated well bore 430 may be lined with a suitable casing 438.

Articulated well bore 430 also includes an enlarged cavity 420 formed in substantially vertical portion 432. In this embodiment, enlarged cavity 420 comprises a generally cylindrical shape; however, enlarged cavities in accordance with other embodiments may comprise other shapes. Enlarged cavity 420 may be formed using suitable under-reaming techniques and equipment, as described in further detail below with respect to FIGS. 5–7. Articulated well bore 430 includes fluids 450. Fluids 450 may comprise drilling fluid and/or drilling mud used in connection with drilling articulated well bore 430, water, gas, for example methane gas released from subterranean zone 415, or other liquids and/or gases. In the illustrated embodiment, methane gas 452 is released from subterranean zone 415 after articulated well bore 430 is drilled.

Enlarged cavity 420 acts as a chamber for the separation of gas and liquid since the cross-sectional area of enlarged cavity 420 is larger than the cross-sectional area of other portions of articulated well bore 430. This allows gas 452 to flow through and up the articulated well bore 430 while liquid separates out from the gas and remains in the enlarged cavity for pumping. Such separation occurs because the velocity of the gas flowing up through the articulated well bore decreases at enlarged cavity 420 below a velocity at which the gas can entrain liquid, thus allowing for the separation of the gas and liquid at enlarged cavity 420. This decrease in velocity results from the larger cross-sectional area of enlarged cavity 420 relative to the cross-sectional area of other portions of articulated well bore 430 through which the gas flows. An enlarged cavity having a larger cross-sectional area may lead to a greater reduction in velocity of the gas flowing up and through the well bore.

A pumping unit 440 is disposed within articulated well bore 430. In this embodiment, pumping unit 440 includes a bent sub section 442 and a pump inlet 444 disposed within enlarged cavity 420. Pumping unit 440 is operable to drain liquid, entrained coal fines and other fluids from articulated well bore 430. As discussed above, such liquid separates from the flow of gas 452 through articulated well bore 430 at enlarged cavity 420. Bent sub section 442 of pumping unit 440 enables pump inlet 444 to be disposed within enlarged cavity 420 at a position that is horizontally offset from the flow of gas 452 through articulated well bore 430 at enlarged cavity 420. In this embodiment, pump inlet 444 is horizontally offset from the longitudinal axis of vertical portion 432 of articulated well bore 430. This position decreases the amount of gas 452 pumped through pump inlet 444 because gas 452 may bypass pump inlet 444 when it releases from subterranean zone 430 and flows through and up articulated well bore 430 where it may be flared, released or recovered. If pump inlet 444 was not horizontally offset from the flow of gas 452 through articulated well bore 430 at enlarged cavity 420, gas 452 may flow into pump inlet 444 when it released from subterranean zone 450. In that case the pump efficiency of the system would be reduced.

Thus, forming enlarged cavity 420 of articulated well bore 430 enables liquid of fluids 450 to separate out from the flow of gas 452 through the well bore. Enlarged cavity 420 also enables a user to position pump inlet 444 offset from the flow of gas 452 through articulated well bore 430 at enlarged cavity 420. Thus, the fluids and entrained coal fines pumped from subterranean zone 415 through articulated well bore 430 will contain less gas, resulting in greater pump efficiency.

Figure 2:
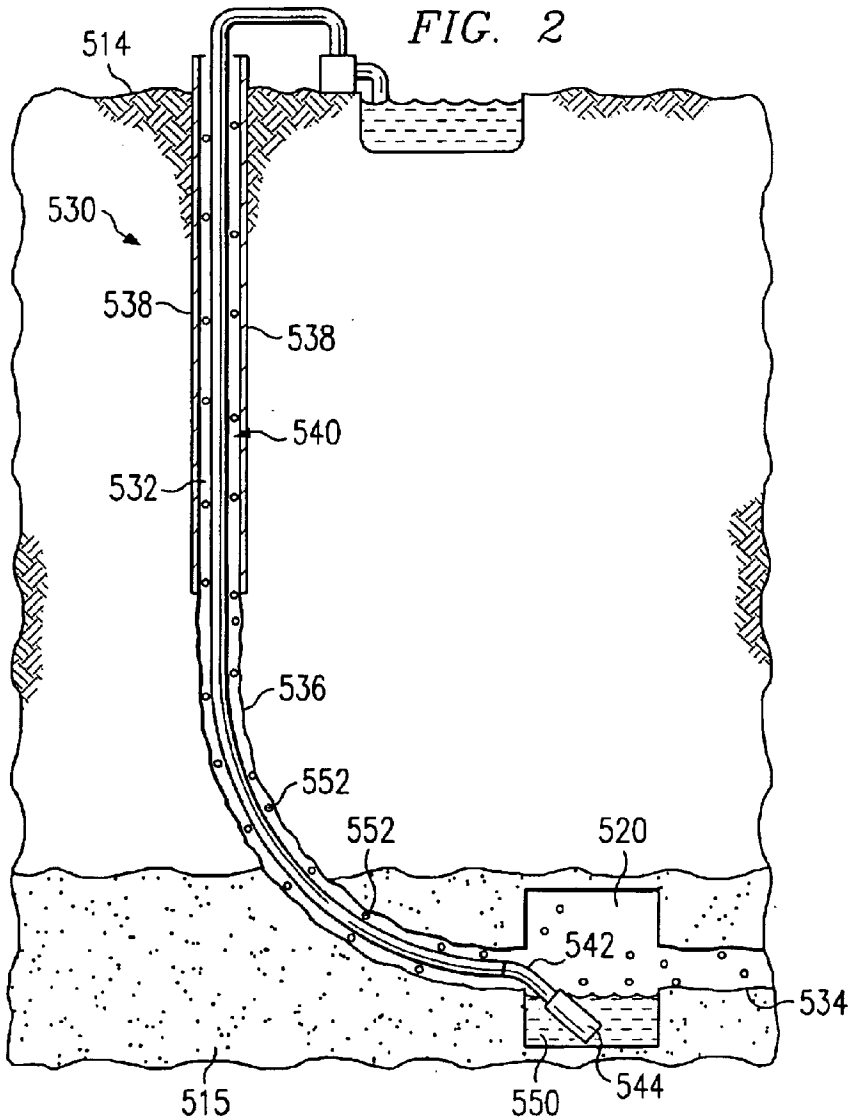
FIG. 2 illustrates an example well system for removing fluid from a subterranean zone utilizing an enlarged cavity in a substantially horizontal portion of an articulated well bore, in accordance with an embodiment of the present invention.

FIG. 2 illustrates another example well system for removing fluid from a subterranean zone. An articulated well bore 530 extends from surface 514 to subterranean zone 515. Articulated well bore 530 includes a substantially vertical portion 532, a substantially horizontal portion 534 and a curved portion 536 interconnecting vertical and horizontal portions 532 and 534. Articulated well bore 530 is lined with a suitable casing 538. Articulated well bore 530 also includes an enlarged cavity 520 formed in substantially horizontal portion 534.

Articulated well bore 530 includes fluids 550. Fluids 550 may comprise drilling fluid and/or drilling mud used in connection with drilling articulated well bore 530, water, gas, for example methane gas released from subterranean zone 515, or other liquids and/or gases. In the illustrated embodiment, methane gas 552 is released from subterranean zone 515 after articulated well bore 530 is drilled. Enlarged cavity 520 acts as a chamber for the separation of gas and liquid much like enlarged cavity 420 of FIG. 1 discussed above.

A pumping unit 540 is disposed within articulated well bore 530. In this embodiment, pumping unit .540 includes a bent sub section 542 and a pump inlet 544 disposed within enlarged cavity 520. Pumping unit 540 is operable to drain liquid, entrained coal fines and other fluid from articulated well bore 530. As discussed above, such liquid separates from the flow of gas .552 through articulated well bore 530 at enlarged cavity 520. Bent sub section 542 of pumping unit 540 enables pump inlet 544 to be disposed within enlarged cavity 520 at a position that is vertically offset from the flow of gas 552 through articulated well bore 530 at enlarged cavity 520. In this embodiment, pump inlet 544 is vertically offset from the longitudinal axis of horizontal portion 534 of articulated well bore 530. This position decreases the amount of gas 552 pumped through pump inlet 544 because gas 552 may bypass pump inlet 544 when it releases from subterranean zone 530 and flows through and up articulated well bore 530. If pump inlet 544 was not vertically offset from the flow of gas 552 through articulated well bore 530 at enlarged cavity 520, gas 552 would likely flow into pump inlet 544 when it released from subterranean zone 550. In that case the pump efficiency of the system would be reduced.

Enlarged cavity 520 also enables a user to position pump inlet 544 offset from the flow of gas 552 through articulated well bore 530 at enlarged cavity 520. Thus, the fluids and entrained coal fines pumped from subterranean zone 515 through articulated well bore 530 will contain less gas, resulting in greater pump efficiency.

Figure 3:
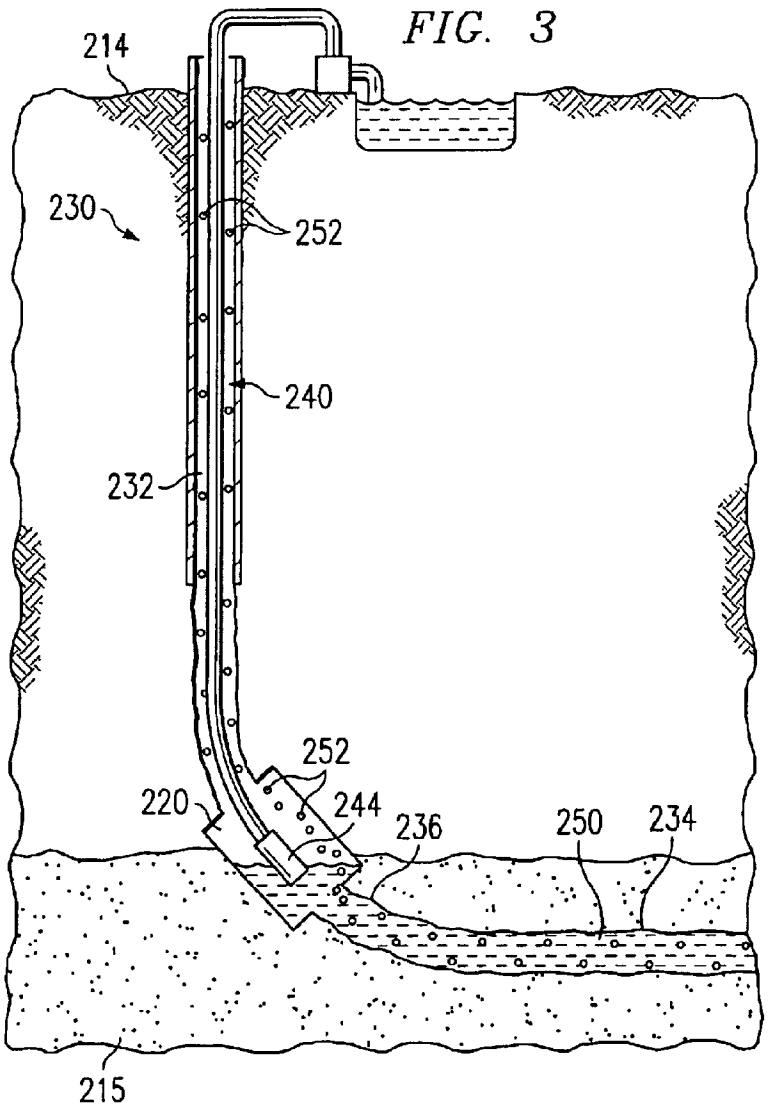
FIG. 3 illustrates an example well system for removing fluid from a subterranean zone utilizing an enlarged cavity in a curved portion of an articulated, well bore, in accordance with an embodiment of the present invention.

FIG. 3 illustrates another example well system for removing fluid from a subterranean zone. An articulated well bore 230 extends from surface 214 to subterranean zone 215. Articulated well bore 230 includes a substantially vertical portion 232, a substantially horizontal portion 234 and a curved portion 236 interconnecting vertical and horizontal portions 232 and 234.

Articulated well bore 230 includes an enlarged cavity 220 formed in curved portion 236. Articulated well bore 230 includes fluids 250. Fluids 250 may comprise drilling fluid and/or drilling mud used in connection with drilling articulated well bore 230, water, gas, for example methane gas released from subterranean zone 215, or other liquids and/or gases. In the illustrated embodiment, methane gas 252 is released from subterranean zone 215 after articulated well bore 230 is drilled. Enlarged cavity 220 acts as a chamber for the separation of gas and liquid much like enlarged cavity 420 of FIG. 1 discussed above.

A pumping unit 240 is disposed within articulated well bore 230. Pumping unit 240 includes a pump inlet 244 disposed within enlarged cavity 220. Pumping unit 240 is operable to drain liquid, entrained coal fines and other fluids from articulated well bore 230. As discussed above, such liquid separates from the flow of gas 252 through articulated well bore 230 at enlarged cavity 220. As illustrated, pump inlet 244 is offset from the flow of gas 252 through articulated well bore 230 at enlarged cavity 220. This decreases the amount of gas 252 pumped through pump inlet 244 because gas 252 may bypass pump inlet 244 when it releases from subterranean zone 230 and flows through and up articulated well bore 230.

Thus, forming enlarged cavity 220 of articulated well bore 230 enables liquids of fluids 250 to separate out from the flow of gas 252 through the well bore. Enlarged cavity 220 also enables a user to position pump inlet 244 offset from the flow of gas 252 through articulated well bore 230 at enlarged cavity 220. Thus, the fluids and entrained coal fines pumped from subterranean zone 215 through articulated well bore 230 will contain less gas, resulting in greater pump efficiency.

Figure 4:
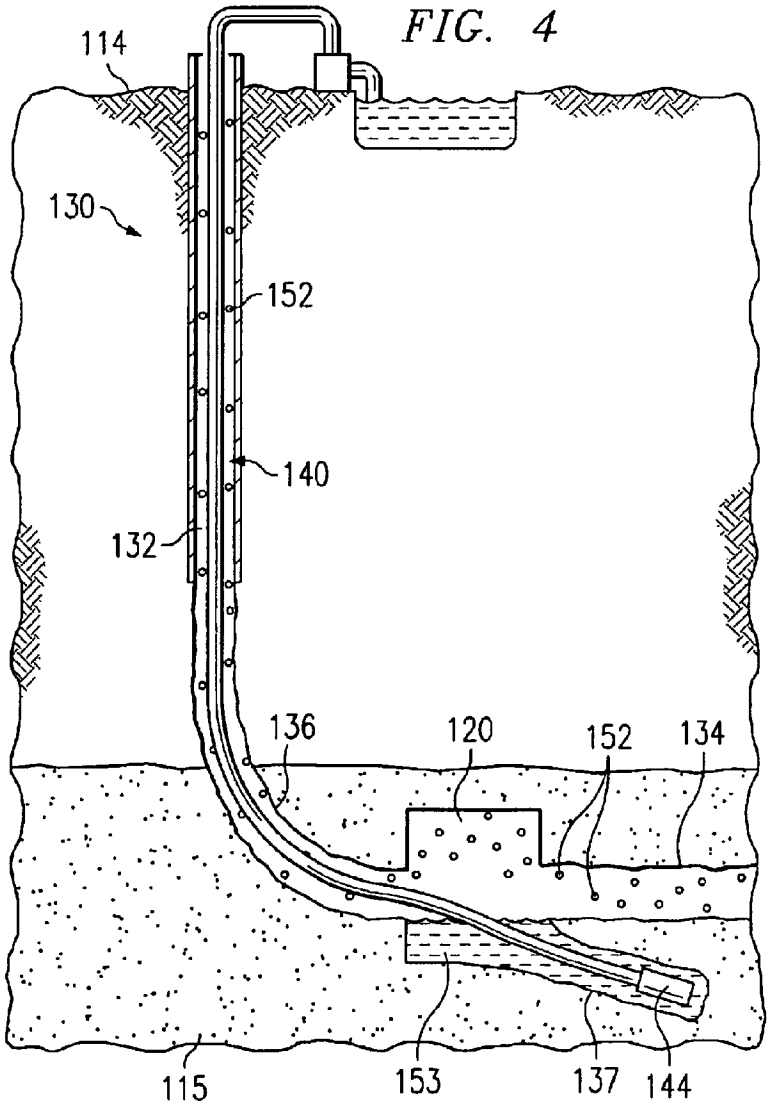
FIG. 4 illustrates an example well system for removing fluid from a subterranean zone utilizing an enlarged cavity and a branch sump of an articulated well bore, in accordance with an embodiment of the present invention.

FIG. 4 illustrates another example well system for removing fluid from a subterranean zone. An articulated well bore 130 extends from surface 114 to subterranean zone 115. Articulated well bore 130 includes a substantially vertical portion 132, a substantially horizontal portion 134, a curved portion 136 interconnecting vertical and horizontal portions 132 and 134, and a branch sump 137.

Articulated well bore 130 includes an enlarged cavity 120. Enlarged cavity 120 acts a chamber for the separation of gas 152 and liquid 153 which are included in fluids released from subterranean zone 115 after articulated well bore 130 is drilled. This allows gas 152 to flow through and up the articulated well bore 130 while liquid 153 separates out from the gas and remains in enlarged cavity 120 and branch sump 137 for pumping. Branch sump 137 provides a collection area from which liquid 153 may be pumped.

A pumping unit 140 is disposed within articulated well bore 130. Pumping unit 140 includes a pump inlet 144 disposed within branch sump 137. Pumping unit 140 is operable to drain liquid 153 and entrained coal fines from articulated well bore 130. As discussed above, such liquid 153 separates from the flow of gas 152 through articulated well bore 130. Thus, forming enlarged cavity 120 of articulated well bore 130 enables liquid 153 to separate out from the flow of gas 152 through the well bore. Thus, the fluids and entrained coal fines pumped from subterranean zone 115 through articulated well bore 130 will contain less gas, resulting in greater pump efficiency.

As described above, FIGS. 1–4 illustrate enlarged cavities formed in a substantially vertical portion, a substantially horizontal portion and a curved portion of an articulated well bore. It should be understood that embodiments of this invention may include an enlarged cavity formed in any portion of an articulated well bore, any portion of a substantially vertical well bore, any portion of a substantially horizontal well bore or any portion of any other well bore, such as a slant well bore.

Figure 5:
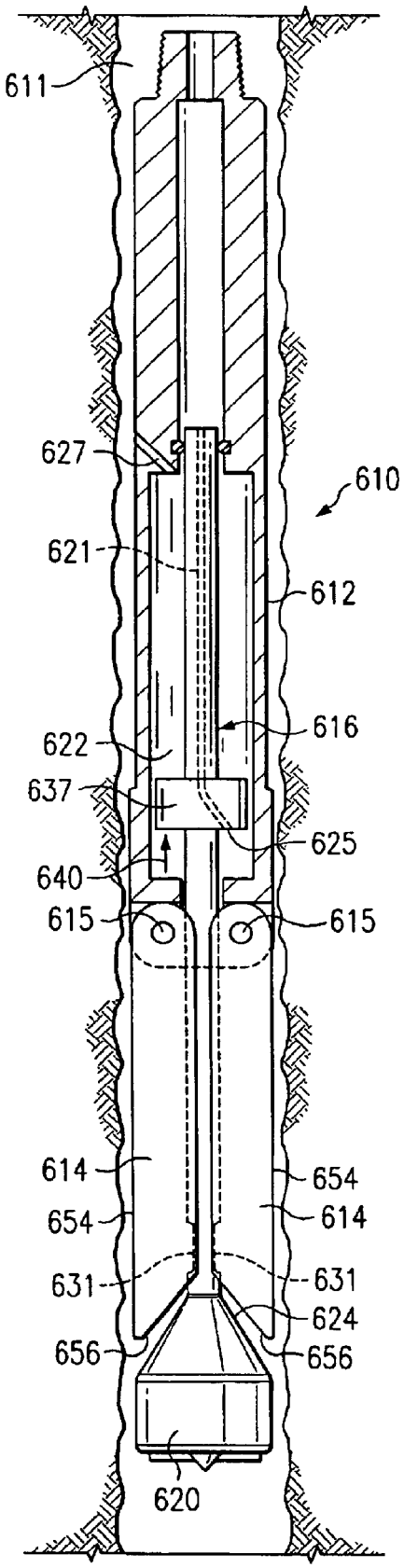
FIG. 5 illustrates an example underreamer used to form an enlarged cavity, in accordance with an embodiment of the present invention.

FIG. 5 illustrates an example underreamer 610 used to form an enlarged cavity, such as enlarged cavity 420 of FIG. 1. Underreamer 610 includes two cutters 614 pivotally coupled to a housing 612. Other underreamers which may be used to form enlarged cavity 420 may have one or more than two cutters 614. In this embodiment, cutters 614 are coupled to housing 612 via pins 615; however, other suitable methods may be used to provide pivotal or rotational movement of cutters 614 relative to housing 612. Housing 612 is illustrated as being substantially vertically disposed within a well bore 611; however, underreamer 610 may form an enlarged cavity while housing 612 is disposed in other positions as well. For example, underreamer 610 may form an enlarged cavity such as enlarged cavity 520 of FIG. 2 while in a substantially horizontal position.

Underreamer 610 includes an actuator 616 with a portion slidably positioned within a pressure cavity 622 of housing 612. Actuator 616 includes a fluid passage 621. Fluid passage 621 includes an outlet 625 which allows fluid to exit fluid passage 621 into pressure cavity 622 of housing 612. Pressure cavity 622 includes an exit vent 627 which allows fluid to exit pressure cavity 622 into well bore 611. In particular embodiments, exit vent 627 may be coupled to a vent hose in order to transport fluid exiting through exit vent 627 to the surface or to another location. Actuator 616 also includes an enlarged portion 620 which, in this embodiment, has a beveled portion 624. However, other embodiments may include an actuator having an enlarged portion that comprises other angles, shapes or configurations, such as a cubical, spherical, conical or teardrop shape. Actuator 616 also includes pressure grooves 631.

Cutters 614 are illustrated in a retracted position, nesting around actuator 616. Cutters 614 may have a length of approximately two to three feet; however the length of cutters 614 may be different in other embodiments. Cutters 614 are illustrated as having angled ends; however, the ends of cutters 614 in other embodiments may not be angled or they may be curved, depending on the shape and configuration of enlarged portion 620. Cutters 614 include side cutting surfaces 654 and end cutting surfaces 656. Cutters 614 may also include tips which may be replaceable in particular embodiments as the tips get worn down during operation. In such cases, the tips may include end cutting surfaces 656. Cutting surfaces 654 and 656 and the tips may be dressed with a variety of different cutting materials, including, but not limited to, polycrystalline diamonds, tungsten carbide inserts, crushed tungsten carbide, hard facing with tube barium, or other suitable cutting structures and materials, to accommodate a particular subsurface formation. Additionally, various cutting surfaces 654 and 656 configurations may be machined or formed on cutters 614 to enhance the cutting characteristics of cutters 614.

In operation, a pressurized fluid is passed through fluid passage 621 of actuator 616. Such disposition may occur through a drill pipe connector connected to housing 612. The pressurized fluid flows through fluid passage 621 and exits the fluid passage through outlet 625 into pressure cavity 622. Inside pressure cavity 622, the pressurized fluid exerts a first axial force 640 upon an enlarged portion 637 of actuator 616. Enlarged portion 637 may be encircled by circular gaskets in order to prevent pressurized fluid from flowing around enlarged portion 637. The exertion of first axial force 640 on enlarged portion 637 of actuator 616 causes movement of actuator 616 relative to housing 612. Such movement causes beveled portion 624 of enlarged portion 620 to contact cutters 614 causing cutters 614 to rotate about pins 615 and extend radially outward relative to housing 612. Through the extension of cutters 614, underreamer 610 forms an enlarged cavity as cutting surfaces 654 and 656 of cutters 614 come into contact with the surfaces of well bore 611.

Housing 612 may be rotated within well bore 611 as cutters 614 extend radially outward to aid in forming an enlarged cavity 642. Rotation of housing 612 may be achieved using a drill string coupled to the drill pipe connector; however, other suitable methods of rotating housing 612 may be utilized. For example, a downhole motor in well bore 611 may be used to rotate housing 612. In particular embodiments, both a downhole motor and a drill string may be used to rotate housing 612. The drill string may also aid in stabilizing housing 612 in well bore 611.

Figure 6:
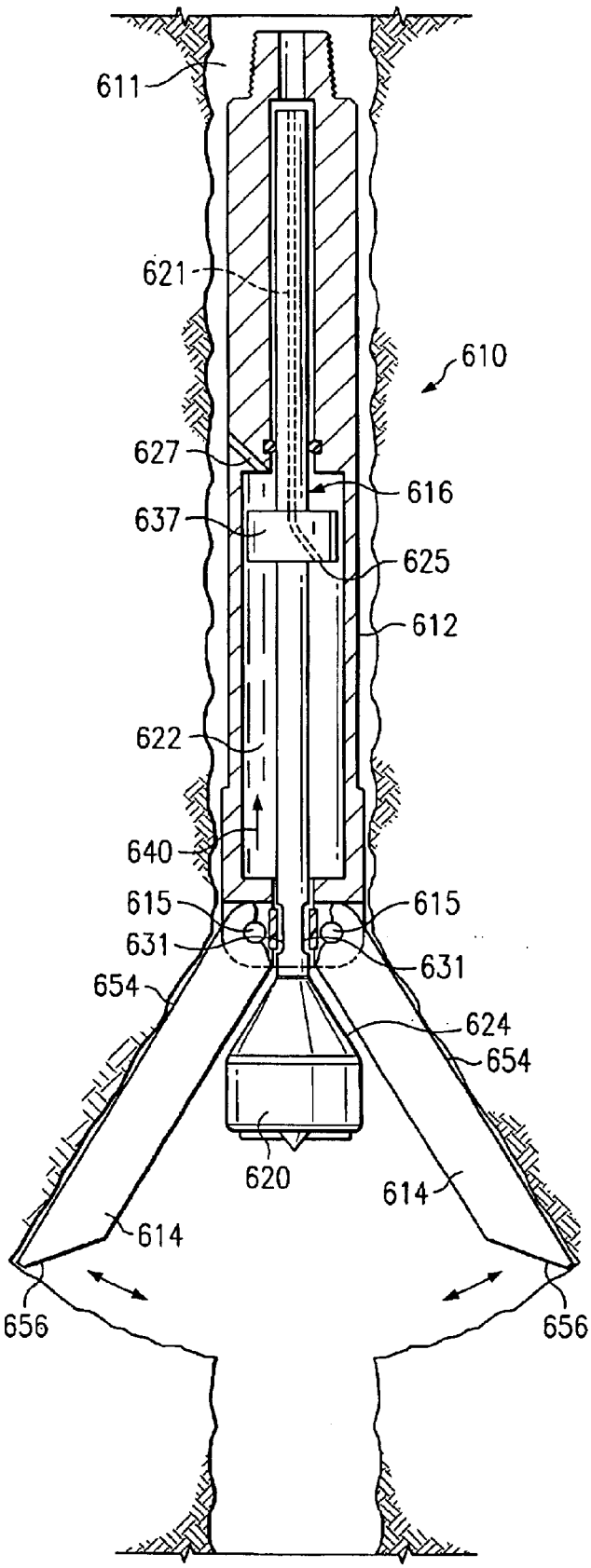
FIG. 6 illustrates the underreamer of FIG. 5 with cutters in a semi-extended position, in accordance with an embodiment of the present invention.

FIG. 6 is a diagram illustrating underreamer 610 of FIG. 5 in a semi-extended position. In FIG. 6, cutters 614 are in a semi-extended position relative to housing 612 and have begun to form an enlarged cavity 642. When first axial force 640 (illustrated in FIG. 5) is applied and actuator 616 moves relative to housing 612, enlarged portion 637 of actuator 616 will eventually reach an end 644 of pressure cavity 622. At this point, enlarged portion 620 is proximate an end 617 of housing 612. Cutters 614 are extended as illustrated and an angle 646 will be formed between them. In this embodiment, angle 646 is approximately sixty degrees, but angle 646 may be different in other embodiments depending on the angle of beveled portion 624 or the shape or configuration of enlarged portion 620. As enlarged portion 637 of actuator 616 reaches end 644 of pressure cavity 622, the fluid within pressure cavity 622 may exit pressure cavity 622 into well bore 611 through pressure grooves 631. Fluid may also exit pressure cavity 622 through exit vent 627. Other embodiments of the present invention may provide other ways for the pressurized fluid to exit pressure cavity 622.

Figure 7:
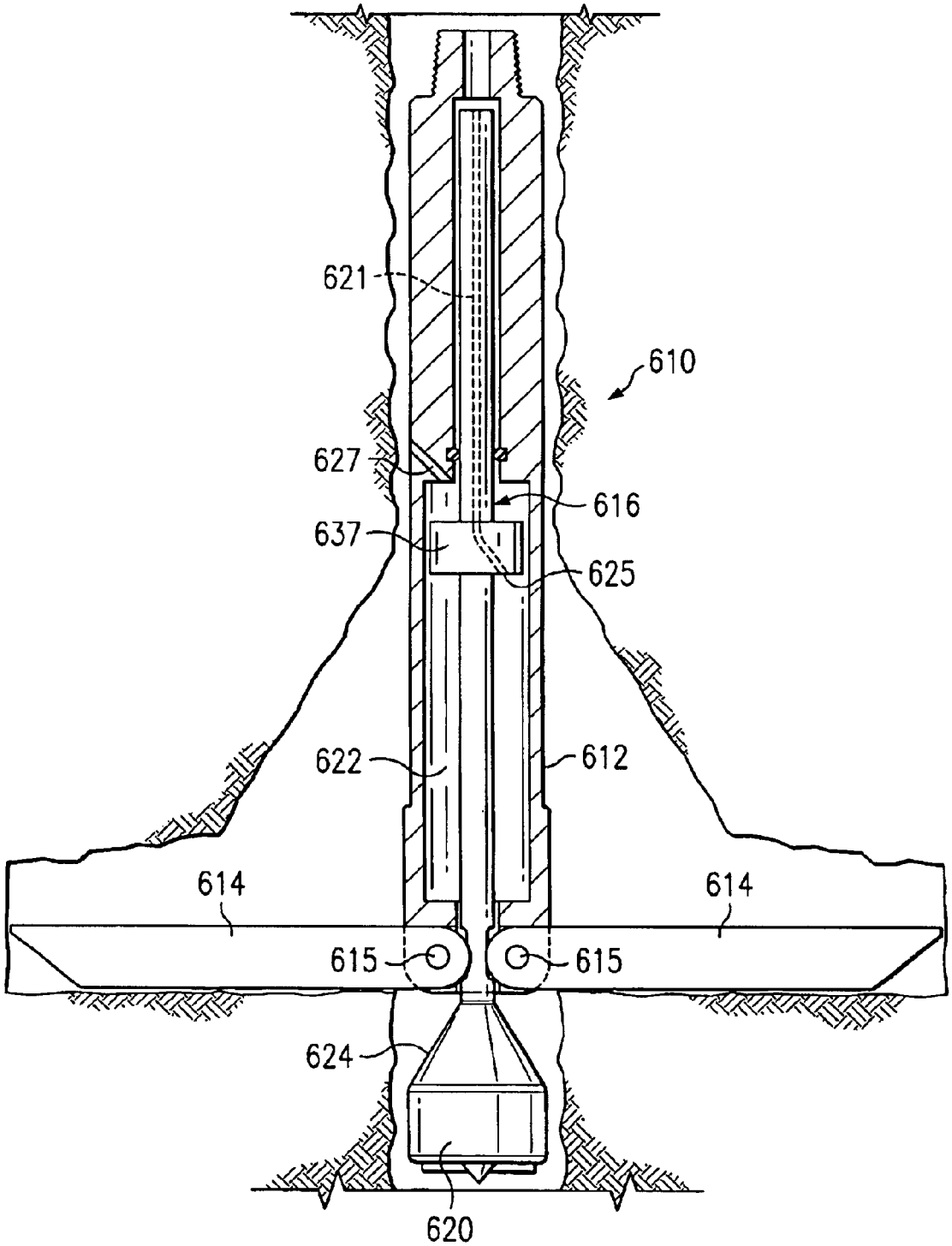
FIG. 7 illustrates the underreamer of FIG. 5 with cutters in an extended position, in accordance with an embodiment of the present invention.

FIG. 7 is a diagram illustrating underreamer 610 of FIG. 6 in an extended position. Once enough first axial force 640 has been exerted on enlarged portion 637 of actuator 616 for enlarged portion 637 to contact end 644 of pressure cavity 622 thereby extending cutters 614 to a semi-extended position as illustrated in FIG. 6, a second axial force 648 may be applied to underreamer 610. Second axial force 648 may be applied by moving underreamer 610 relative to well bore 611. Such movement may be accomplished by moving the drill string coupled to the drill pipe connector or by any other technique. The application of second axial force 648 forces cutters 614 to rotate about pins 615 and further extend radially outward relative to housing 612. The application of second axial force 648 may further extend cutters 614 to a position where they are approximately perpendicular to a longitudinal axis of housing 612, as illustrated in FIG. 7. Housing 612 may include a bevel or "stop" in order to prevent cutters 614 from rotating passed a particular position, such as an approximately perpendicular position to a longitudinal axis of housing 612 as illustrated in FIG. 7.

As stated above, housing 612 may be rotated within well bore 611 when cutters 614 are extended radially outward to aid in forming enlarged cavity 642. Underreamer 610 may also be raised and lowered within well bore 611 to further define and shape cavity 642. It should be understood that a subterranean cavity having a shape other than the shape of cavity 642 may be formed with underreamer 610.

Figure 8:
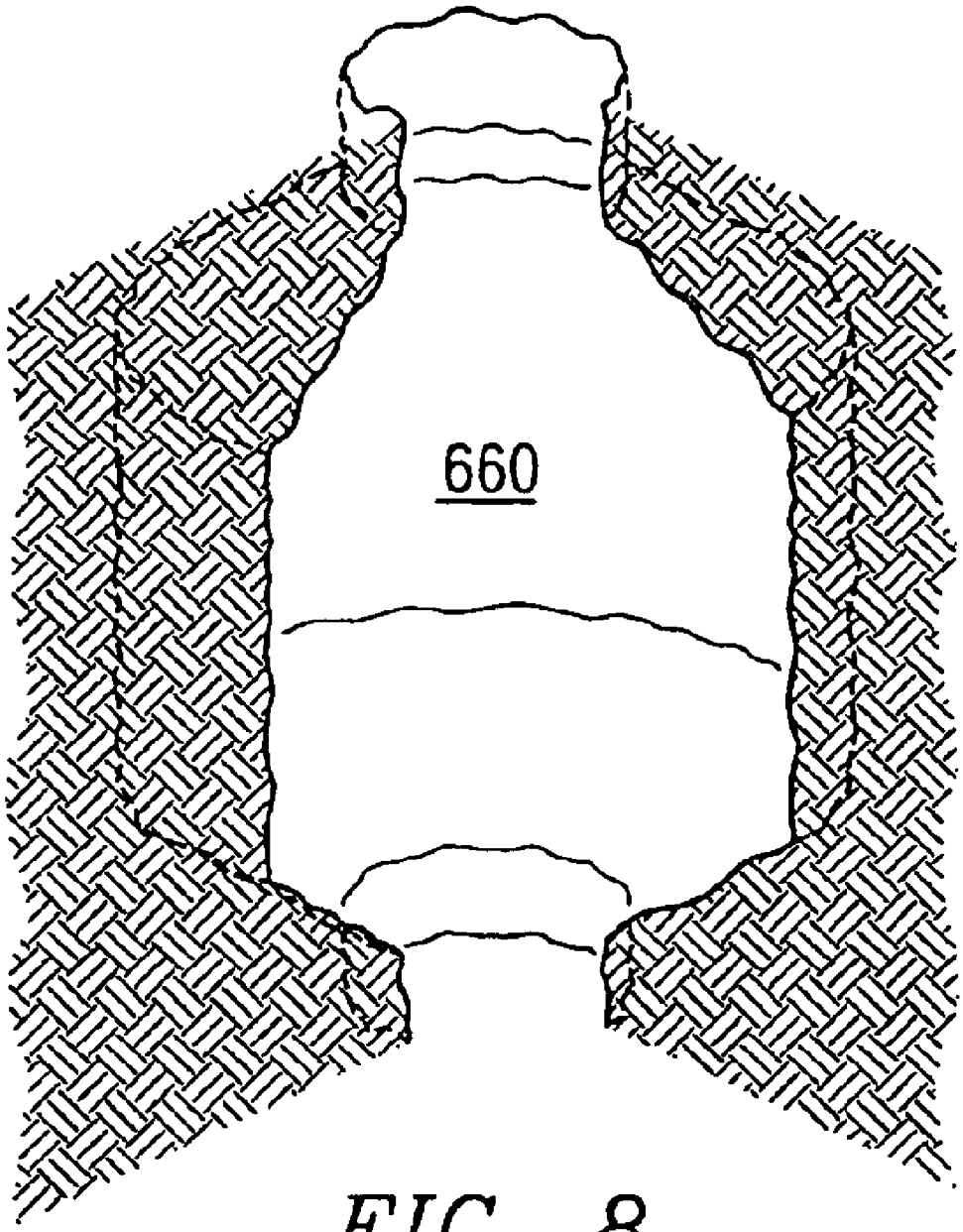
FIG. 8 is an isometric diagram illustrating an enlarged cavity having a generally cylindrical shape, in accordance with an embodiment of the present invention.

FIG. 8 is an isometric diagram illustrating an enlarged cavity 660 having a generally cylindrical shape which may be formed using underreamer 610 of FIGS. 5–7. Enlarged cavity 660 may be formed by raising and/or lowering the underreamer in the well bore and by rotating the underreamer. Enlarged cavity 660 is also an example of cavity 420 of FIG. 1.

Although enlarged cavities having a generally cylindrical shape have been illustrated, it should be understood that an enlarged cavity having another shape may be used in accordance with particular embodiments of the present invention. Furthermore, an enlarged cavity may be formed by using an underreamer as described herein or by using other suitable techniques or methods, such as blasting or solution mining.

Although the present invention has been described in detail, various changes and modifications may be suggested to one skilled in the art. It is intended that the present invention encompass such changes and modifications as falling within the scope of the appended claims.

What is claimed is:

1. A method for removing fluid from a subterranean zone, comprising:

drilling an articulated well bore from a surface to the subterranean zone;

forming an enlarged cavity in the articulated well bore such that the enlarged cavity acts as a chamber to separate liquid from gas flowing from the subterranean zone through the articulated well bore;

inserting a portion of a pumping unit having a pump inlet through a curved portion of the articulated well bore;

positioning the pump inlet within the enlarged cavity; and operating the pumping unit to produce the liquid through the pump inlet.

2. The method of claim 1, wherein positioning the pump inlet within the enlarged cavity comprises positioning the pump inlet within the enlarged cavity such that the pump inlet is offset from the flow of gas through the articulated well bore.

3. The method of claim 1, wherein:

the articulated well bore comprises a substantially vertical portion;

forming an enlarged cavity in the articulated well bore comprises forming an enlarged cavity in the substantially vertical portion of the articulated well bore; and positioning the pump inlet within the enlarged cavity comprises positioning the pump inlet such that the pump inlet is horizontally offset from a longitudinal axis of the substantially vertical portion of the articulated well bore.

4. The method of claim 1, wherein:

forming an enlarged cavity in the articulated well bore comprises forming an enlarged cavity in the curved portion of the articulated well bore; and positioning a pump inlet within the enlarged cavity comprises positioning a pump inlet such that the pump inlet is offset from the flow of gas through the curved portion.

5. A system for removing fluid from a subterranean zone, comprising:

an articulated well bore extending from a surface to the subterranean zone;

an enlarged cavity formed in the articulated well bore, the enlarged cavity configured to act as a chamber to separate liquid from gas flowing from the subterranean zone through the articulated well bore;

a pumping unit having a pump inlet, the pumping unit having a portion extending from the surface through a curved portion of the articulated well bore such that the pump inlet is positioned within the enlarged cavity; and wherein the pumping unit is operable to produce the liquid through the pump inlet.

6. The system of claim 5, wherein the pump inlet is positioned offset from the flow of gas through the articulated well bore.

7. The system of claim 5, wherein:

the articulated well bore comprises a substantially horizontal portion;

an enlarged cavity formed in the well bore comprises an enlarged cavity formed in the substantially horizontal portion of the articulated well bore; and the pump inlet is vertically offset from a longitudinal axis of the substantially horizontal portion of the articulated well bore.

8. The system of claim 5, wherein:

an enlarged cavity formed in the articulated well bore comprises an enlarged cavity formed in the curved portion of the articulated well bore; and the pump inlet is offset from the flow of gas through the curved portion.

9. A method for removing fluid from a subterranean zone, comprising:

drilling an articulated well bore from a surface to the subterranean zone;

forming an enlarged cavity in the articulated well bore;

inserting a portion of a pumping unit having a pump inlet through a curved portion of the articulated well bore;

positioning the pump inlet within the enlarged cavity such that the pump inlet is offset from a flow of gas from the subterranean zone through the well bore; and operating a pumping unit to produce liquid through the pump inlet.

10. The method of claim 9, wherein:

the articulated well bore comprises a substantially horizontal portion;

forming an enlarged cavity in the articulated well bore comprises forming an enlarged cavity in the substantially horizontal portion of the articulated well bore; and positioning the pump inlet within the enlarged cavity such that the pump inlet is offset from the flow of gas from the subterranean zone through the well bore comprises positioning the pump inlet such that the pump inlet is vertically offset from a longitudinal axis of the substantially horizontal portion of the articulated well bore.

11. The method of claim 9, wherein:

forming an enlarged cavity in the articulated well bore comprises forming an enlarged cavity in the curved portion of the articulated well bore.

12. A method for removing fluid from a subterranean zone, comprising:

drilling an articulated well bore from a surface to the subterranean zone;

forming an enlarged cavity in the articulated well bore;

inserting a portion of a pumping unit having a pump inlet through the articulated well bore;

positioning the pump inlet within the enlarged cavity such that the pump inlet is offset from a flow of gas from the subterranean zone through the well bore; and operating a pumping unit to produce liquid through the pump inlet; and wherein:

the articulated well bore comprises a substantially vertical portion;

the step of forming an enlarged cavity in the articulated well bore comprises forming an enlarged cavity in the substantially vertical portion of the articulated well bore; and the step of positioning a pump inlet within the enlarged cavity such that the pump inlet is offset from the flow of gas from the subterranean zone through the articulated well bore comprises positioning the pump inlet such that the pump inlet is horizontally offset from a longitudinal axis of the substantially vertical portion of the articulated well bore.

13. A system for removing fluid from a subterranean zone, comprising:

an articulated well bore extending from a surface to the subterranean zone;

an enlarged cavity formed in the well bore;

a pumping unit having a pump inlet, the pumping unit having a portion extending from the surface through a curved portion of the articulated well bore such that the pump inlet is positioned within the enlarged cavity such that the pump inlet is offset from a flow of gas from the subterranean zone through the well bore; and wherein the pumping unit is operable to produce liquid through the pump inlet.

14. The system of claim 13, wherein:

the articulated well bore comprises a substantially horizontal portion;

an enlarged cavity formed in the articulated well bore comprises an enlarged cavity formed in the substantially horizontal portion of the articulated well bore; and the pump inlet is vertically offset from a longitudinal axis of the substantially horizontal portion of the articulated well bore.

15. The system of claim 13, wherein:

an enlarged cavity formed in the articulated well bore comprises an enlarged cavity formed in the curved portion of the articulated well bore.

16. A system for removing fluid from a subterranean zone, comprising:

an articulated well bore extending from a surface to the subterranean zone;

an enlarged cavity formed in the well bore;

a pumping unit having a pump inlet, the pumping unit having a portion extending from the surface through the articulated well bore such that the pump inlet is positioned within the enlarged cavity such that the pump inlet is offset from a flow of gas from the subterranean zone through the well bore; and wherein the pumping unit is operable to produce liquid through the pump inlet; and wherein:

the articulated well bore comprises a substantially vertical portion;

an enlarged cavity formed in the articulated well bore comprises an enlarged cavity formed in the substantially vertical portion of the articulated well bore; and the pump inlet is horizontally offset from a longitudinal axis of the substantially vertical portion of the articulated well bore.

17. A method for removing fluid from a subterranean zone, comprising:

drilling an articulated well bore from a surface to the subterranean zone;

forming an enlarged cavity in the articulated well bore such that the enlarged cavity acts as a chamber to separate liquid from gas flowing from the subterranean zone through the articulated well bore;

inserting a portion of a pumping unit having a pump inlet through a curved portion of the articulated well bore;

positioning the pump inlet within a portion of the well bore; and operating the pumping unit to produce the liquid through the pump inlet.

18. The method of claim 17, wherein:

the articulated well bore comprises a branch sump that collects the liquid separated from gas at the enlarged cavity; and positioning the pump inlet within a portion of the articulated well bore comprises positioning the pump inlet within the branch sump of the articulated well bore.

19. A system for removing fluid from a subterranean zone, comprising:

an articulated well bore extending from a surface to the subterranean zone;

an enlarged cavity formed in the well bore, the enlarged cavity configured to act as a chamber to separate liquid from gas flowing from the subterranean zone through the well bore;

a pumping unit having a pump inlet, the pumping unit having a portion extending from the surface through a curved portion of the articulated well bore such that the pump inlet is positioned within the articulated well bore; and wherein the pumping unit is operable to produce the liquid through the pump inlet.

20. The system of claim 19, wherein:

the articulated well bore comprises a branch sump configured to collect the liquid that separates from gas at the enlarged cavity; and the pump inlet is positioned within the branch sump of the articulated well bore.

21. A method for removing fluid from a subterranean zone, comprising:

drilling an articulated well bore from a surface to the subterranean zone;

forming an enlarged cavity in the articulated well bore apart from any intersection with any wellbore from the surface, the enlarged cavity adapted to act as a chamber to separate liquid from gas flowing from the subterranean zone through the articulated well bore;

positioning at least a portion of a pumping unit in a curved portion of the articulated well bore, the pumping unit comprising a pump inlet; and operating the pumping unit to produce the liquid through the pump inlet.

22. The method of claim 21, wherein positioning at least a portion of the pumping unit in the curved portion of the articulated well bore comprises positioning the pump inlet offset from the flow of gas through the articulated well bore.

23. The method of claim 21, wherein positioning at least a portion of the pumping unit in the curved portion of the articulated well bore comprises positioning the pump inlet within the enlarged cavity.

24. The method of claim 21, wherein:

the articulated well bore comprises a branch sump that collects the liquid separated from gas at the enlarged cavity; and positioning at least a portion of the pumping unit in the curved portion of the articulated well bore comprises positioning the pump inlet within the branch sump of the articulated well bore.

25. The method of claim 21, wherein:

the articulated well bore comprises a substantially horizontal portion;

forming an enlarged cavity in the articulated well bore comprises forming an enlarged cavity in the substantially horizontal portion of the articulated well bore; and positioning at least a portion of a pumping unit in a curved portion of the articulated well bore comprises positioning the pump inlet vertically offset from a longitudinal axis of the substantially horizontal portion of the articulated well bore.

26. The method of claim 21, wherein:

forming an enlarged cavity in the articulated well bore comprises forming an enlarged cavity in the curved portion of the articulated well bore; and positioning at least a portion of a pumping unit in a curved portion of the articulated well bore comprises positioning the pump inlet offset from the flow of gas through the curved portion.

27. A method for removing fluid from a subterranean zone, comprising:

drilling an articulated well bore from a surface to the subterranean zone;

forming an enlarged cavity in the articulated well bore apart from any intersection with any wellbore from the surface, the enlarged cavity adapted to act as a chamber to separate liquid from gas flowing from the subterranean zone through the articulated well bore;

positioning a pump inlet within a portion of the articulated well bore; and operating a pumping unit to produce the liquid through the pump inlet; and where:

the articulated well bore comprises a substantially vertical portion;

the step of forming an enlarged cavity in the articulated well bore comprises forming an enlarged cavity in the substantially vertical portion of the articulated well bore; and the step of positioning a pump inlet within a portion of the articulated well bore comprises positioning a pump inlet such that the pump inlet is horizontally offset from a longitudinal axis of the substantially vertical portion of the articulated well bore.

28. A system for removing fluid from a subterranean zone, comprising:

an articulated well bore extending from a surface to the subterranean zone;

an enlarged cavity formed in the articulated well bore apart from any intersection with any other well bore from the surface, the enlarged cavity configured to act as a chamber to separate liquid from gas flowing from the subterranean zone through the articulated well bore;

a pumping unit at least partially residing in a curved portion of the articulated well bore and having a pump inlet; and wherein the pumping unit is operable to produce the liquid through the pump inlet.

29. The system of claim 28, wherein the pump inlet is offset from the flow of gas through the articulated well bore.

30. The system of claim 28, wherein the pump inlet is positioned within the enlarged cavity.

31. The system of claim 28, wherein:

the articulated well bore comprises a branch sump configured to collect the liquid that separates from gas at the enlarged cavity; and the pump inlet is positioned within the branch sump of the articulated well bore.

32. The system of claim 28, wherein:

the articulated well bore comprises a substantially horizontal portion;

an enlarged cavity formed in the well bore comprises an enlarged cavity formed in the substantially horizontal portion of the articulated well bore; and the pump inlet is vertically offset from a longitudinal axis of the substantially horizontal portion of the articulated well bore.

33. The system of claim 28, wherein:

an enlarged cavity formed in the articulated well bore comprises an enlarged cavity formed in the curved portion of the articulated well bore; and the pump inlet is offset from the flow of gas through the curved portion.

34. A system for removing fluid from a subterranean zone, comprising:

an articulated well bore extending from a surface to the subterranean zone;

an enlarged cavity formed in the articulated well bore apart from any intersection with any other well bore from the surface, the enlarged cavity configured to act as a chamber to separate liquid from gas flowing from the subterranean zone through the articulated well bore;

a pumping unit having a pump inlet positioned within the well bore; and wherein the pumping unit is operable to produce the liquid through the pump inlet; and wherein:

the articulated well bore comprises a substantially vertically portion;

an enlarged cavity formed in the articulated well bore comprises an enlarged cavity formed in the substantially vertical portion of the articulated well bore; and the pump inlet is horizontally offset from a longitudinal axis of the substantially vertical portion of the articulated well bore.

* * * * *